US007255533B2

(12) United States Patent
Takemoto

(10) Patent No.: US 7,255,533 B2
(45) Date of Patent: Aug. 14, 2007

(54) CENTRIFUGAL FAN

(75) Inventor: Shinji Takemoto, Kyoto (JP)

(73) Assignee: Nidec Corporation, Kyoto (JP)

( * ) Notice: Subject to any disclaimer, the term of this patent is extended or adjusted under 35 U.S.C. 154(b) by 0 days.

(21) Appl. No.: 11/282,565

(22) Filed: Nov. 21, 2005

(65) Prior Publication Data

US 2006/0110250 A1 May 25, 2006

(30) Foreign Application Priority Data

Nov. 19, 2004 (JP) ..... 2004-336702

(51) Int. Cl.
*F03B 1/04* (2006.01)

(52) U.S. Cl. ..... 415/207; 415/212.1

(58) Field of Classification Search ..... 415/204, 415/206, 207, 212.1
See application file for complete search history.

(56) References Cited

U.S. PATENT DOCUMENTS 5,839,879 A * 11/1998 Kameoka et al. ..... 415/206
6,588,228 B2 7/2003 Choi

FOREIGN PATENT DOCUMENTS

| | | |
|---|---|---|
| JP | S52-140408 | 10/1977 |
| JP | S53-38248 | 4/1978 |
| JP | S58-70498 | 5/1983 |
| JP | 60-145497 | 7/1985 |
| JP | 2003-69265 | 3/2003 |

* cited by examiner

*Primary Examiner*—Edward K. Look
*Assistant Examiner*—Dwayne J White
(74) *Attorney, Agent, or Firm*—Westerman, Hattori, Daniels & Adrian, LLP

(57) ABSTRACT

It is possible to keep a diameter of an impeller and a cross sectional area of an air channel as large as possible while reducing a size of a centrifugal fan in a direction perpendicular to an axis. Thereby, it is possible to acquire characteristics of a high air volume and a high static pressure without lowering the efficiency. In the centrifugal fan, when the radial gap of the cross section in an air channel 10*b* is gradually enlarged from a clapper portion 10*c* toward an outlet 10*d* except for a specific region 10*h*, the cross inner sectional area of an air channel 10*b* is gradually enlarged from the clapper portion 10*c* toward the outlet 10*d*.

6 Claims, 5 Drawing Sheets

CENTRIFUGAL FAN

BACKGROUND OF THE INVENTION

1. Field of the Invention

The present invention relates to a centrifugal fan, and particularly, the present invention relates to a centrifugal fan such as a compact sirocco fan and a turbo-fan or the like.

2. Description of the Related Art

In a centrifugal fan for use in electronics devices, the size of the centrifugal fan in a direction perpendicular to a rotation axis (namely, a radial direction) may be restricted or the size of the centrifugal fan in a rotation axial direction (namely, an axial direction) may be restricted. In this case, it is necessary to reduce the size of an air channel of a casing having a motor and an impeller therein or, in addition to this, to reduce the diameter of the impeller. However, in the centrifugal fan having such configuration, there is a problem that the performance is lowered and the noise is increased.

Therefore, among such centrifugal fans, there is a configuration such that an inner cross section of the air channel is enlarged in the axial direction from the middle of the air channel through an air outlet.

However, in these arts, there is no reference to problems such as restriction of the size of the centrifugal fan in a direction perpendicular to a rotation axis and lowering of the performance due to miniaturization of the air channel and the impeller caused by the restriction.

BRIEF SUMMARY OF THE INVENTION

Accordingly, the object of the present invention is to provide a centrifugal fan in which both of the diameter of the impeller and the cross sectional area of the air channel of the casing can be kept as large as possible while reducing the size of the centrifugal fan in the direction perpendicular to the rotation axis. In addition, the other object of the present invention is to provide a centrifugal fan capable of acquiring characteristics of a high air volume and a high static pressure without lowering the efficiency.

A centrifugal fan for use in an electric device comprising: a motor including a static part and a rotational part rotating around a rotational axis; an impeller having a tubular-shaped outline that is mounted on a radially outer circumferential part of the rotational part; and a casing housing the impeller and the motor, wherein the casing includes: an upper plate and a lower plate which are located in parallel and opposing each other in axial direction; a peripheral wall portion formed at a radially outer circumference of the casing, wherein a curvature radius of the peripheral wall portion with respect to the rotational axis is gradually enlarged; and a blowing opening formed by the opposite ends of the peripheral wall portion and ends of the upper plate and lower plate; wherein an air channel is formed within a space enclosed by the upper plate and the lower plate, a radial outer circumference of the impeller and an inner circumferential surface of the peripheral wall portion of the casing, a radial gap is defined as a distance from the radial outer circumference of the impeller to an inner circumferential surface of the peripheral wall portion and the radial gap is gradually enlarged along a rotational direction of the impeller except for one or more specific regions, an air channel enlarged part is located at a vicinity of the specific region, an axial gap between the upper plate and the lower plate at the air channel enlarged portion is enlarged along a rotational direction of the impeller, a cross sectional area of the air channel cut by a plain passing through the rotational axis is kept constant or is gradually enlarged along the rotational direction of the impeller.

In addition, a centrifugal fan for use in an electric device comprising: a motor including a static part and a rotational part rotating around a rotational axis; an impeller having a tubular-shaped outline that is mounted on a radially outer circumferential part of the rotational part; and a casing housing the impeller and the motor, wherein the casing includes: an upper plate and a lower plate which are located in parallel and opposing each other in axial direction; a peripheral wall portion formed at a radially outer circumference of the casing, wherein a curvature radius of the peripheral wall portion with respect to the rotational axis is gradually enlarged; and a blowing opening formed by the opposite ends of the peripheral wall portion and ends of the upper and lower plates; wherein an air channel is formed within a space enclosed by the upper and the lower plates, a radial outer circumference of the impeller and an inner circumferential surface of the peripheral wall portion of the casing, a radial gap is defined as a distance from the radial outer circumference of the impeller to an inner circumferential surface of the peripheral wall portion and the radial gap is gradually enlarged along a rotational direction of the impeller except for one or more specific regions, an air channel enlarged part is located at a vicinity of the specific region, a radial gap between the radial outer circumference of the impeller and the inner circumferential side surface of the peripheral wall of the casing is enlarged along a rotational direction of the impeller, a cross sectional area of the air channel cut by a plain passing through the rotational axis is kept constant or is gradually enlarged along the rotational direction of the impeller.

According to the centrifugal fan of the present invention, in the air channel part, its cross section area at a plain passing through the rotational axis of the entire air channel is kept constant or is gradually enlarged along the rotational direction of the impeller when the radial gap or the axial gap of the air channel is gradually enlarged along the rotational direction of the impeller except for a specific region. At the specific region, the radial gap or the axial gap of the cross sectional area is kept constant or is gradually reduced and the inner cross section of the air channel is enlarged in the axial direction or the radial direction. Here, it is assumed that the cross sectional area of the air channel is entirely kept constant or is gradually enlarged along the rotational direction of the impeller. Therefore, it is possible to make both of the diameter of the impeller and the cross sectional area of the air channel of a scroll casing as large as possible while reducing the size of the centrifugal fan as much as possible. Thereby, it is possible to acquire characteristics of the high air volume and the high static pressure without lowering the efficiency.

There and other objects, features and advantages of the present invention will become more apparent upon reading of the following detailed description along with the accompanied drawings.

DETAILED DESCRIPTION OF THE INVENTION

The first embodiment of the present invention will be described below with reference to the drawings.

Figure 1:
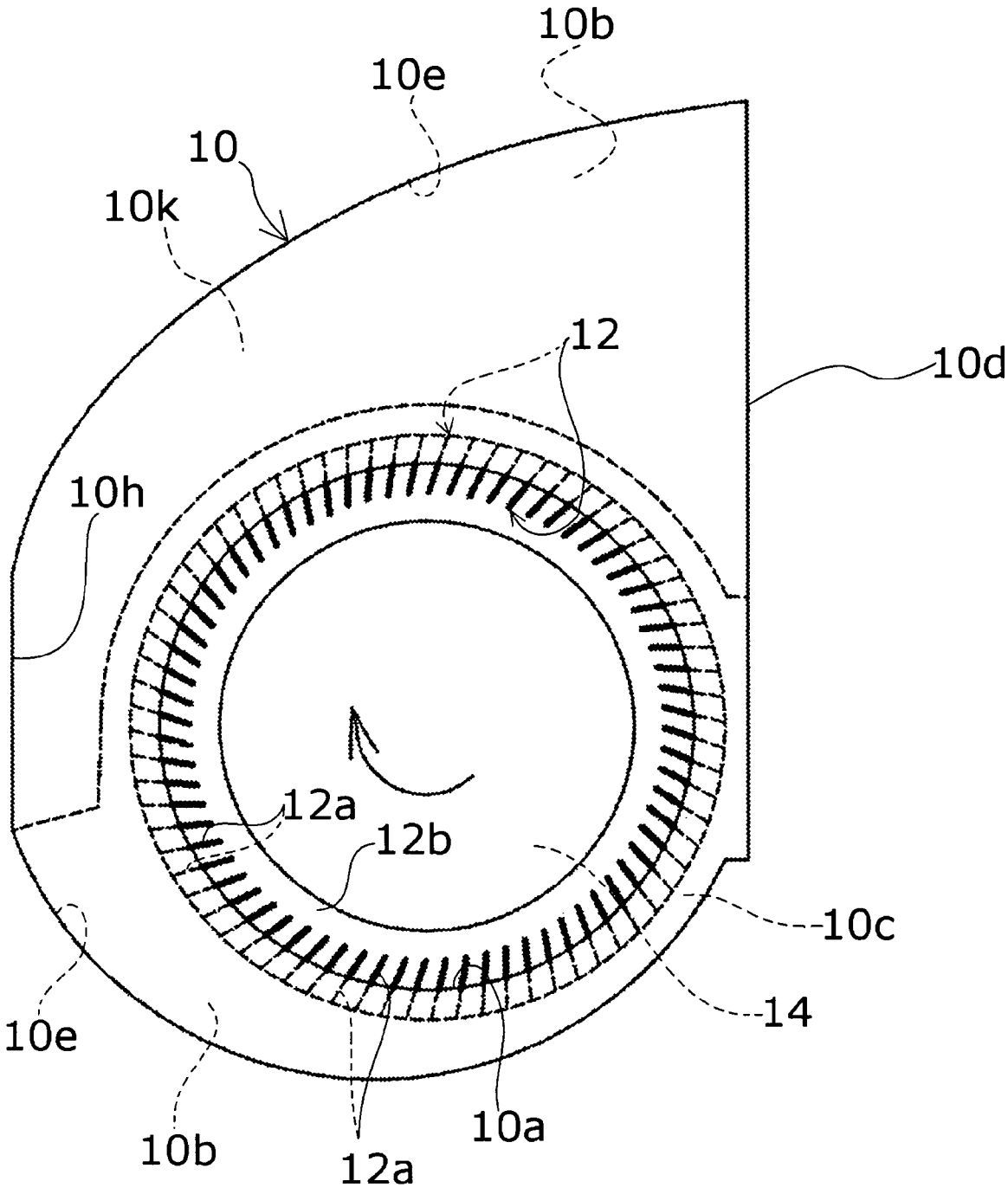
FIG. 1 is a front view of a centrifugal fan according to a first embodiment of the present invention.
Figure 2:
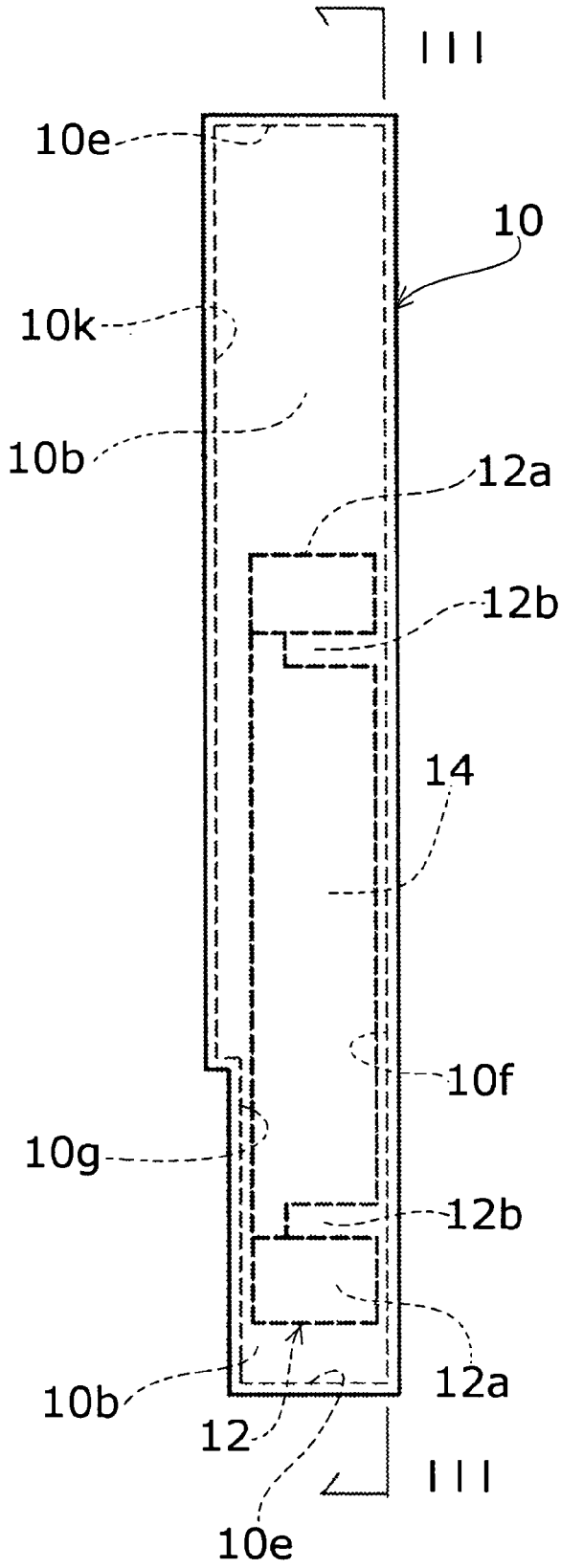
FIG. 2 is a left side view of the centrifugal fan according to the first embodiment of the present invention.
Figure 3:
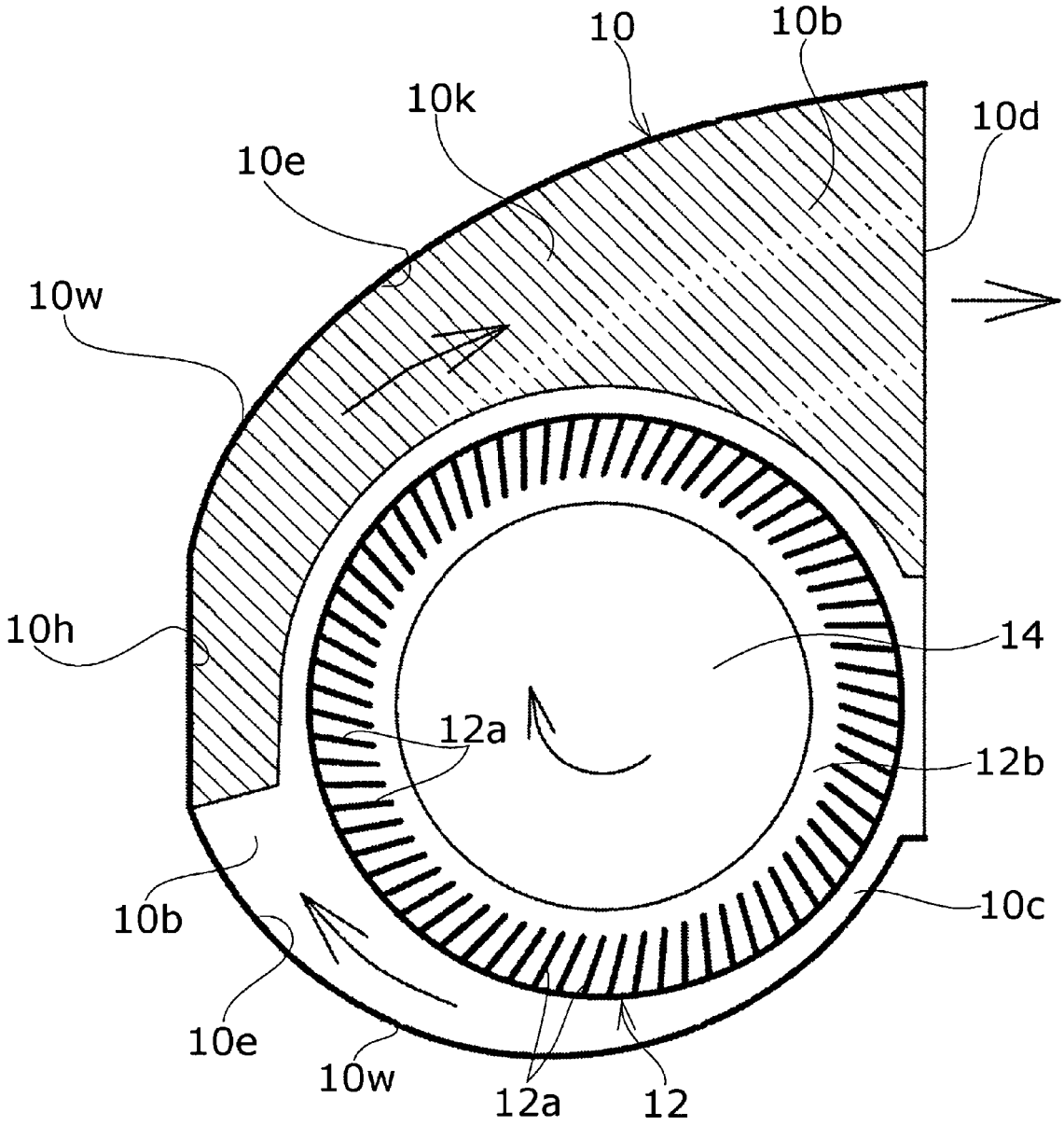
FIG. 3 is a cross sectional view of the centrifugal fan according to the first embodiment taken on a line II-II shown in FIG. 2.

The drawings all relate to the embodiment of the present invention. FIG. 1 is a front view of a centrifugal fan, FIG. 2 is a left side view of the centrifugal fan, and FIG. 3 is a cross sectional view of the centrifugal fan taken on a line II-II shown in FIG. 2.

This centrifugal fan (namely, a sirocco fan) is mainly composed of a scroll casing 10, a multi-wing impeller 12, and an electric machinery for rotatably driving the multi-wing impeller 12. In this example, the impeller 12 is the multi-wing impeller 12, however, the impeller 12 is not limited to this and for example, the impeller 12 may be a radial fan or a centrifugal turbo-fan or the like.

The multi-wing impeller 12 is integrally formed with a rotor 14 of the electric machinery having a stator (not illustrated) fixed to a rear side in the casing 10. The multi-wing impeller 12 is rotatably driven in clockwise direction in FIG. 1 and FIG. 3. Many forward-looking wings 12*a* of the multi-wing impeller 12 are formed at an external peripheral border of the rotor 14 across an annular groove part 12*b*. At a front face side of the casing 10 (at one end of the shaft of the impeller 12), a circle inlet 10*a* is formed so that its external peripheral border is located at the middle position of each wing 12*a* of the multi-wing impeller 12.

An air channel 10*b* of the casing 10 is formed in a scroll-like shape surrounding the multi-wing impeller 12. The air channel 10*b* of the casing 10 is located at a right upper part rounding the multi-wing impeller 12 from a clapper portion 10*c* (a start point) located at a right lower part in FIG. 1 and FIG. 3 in a clockwise direction, namely, the rotational direction of the multi-wing impeller 12, and then, the air channel 10*b* reaches an outlet (a blowing opening) 10*d* (a terminal end).

An external end portion of each wing 12*a* in the multi-wing impeller 12 is facing the inner circumference of the air channel 10*b*. The inner surface other than the inner circumference of the air channel 10*b* is configured by an outer circumferential side inner surface 10*e* defined by an inner side surface of a peripheral wall 10*w* of the casing 10, and a front side inner surface 10*f* and a rear side inner surface 10*g* composed of the upper plate and lower plate opposing each other in the axial direction of the impeller 12. The outer circumferential side inner surface 10*e* is formed in parallel with the axis of the impeller 12. Both of the front side inner surface 10*f* and the rear side inner surface 10*g* are formed perpendicular to the axis of the impeller 12. The front side inner surface 10*f* and the rear side inner surface 10*g* are in parallel with each other. The front side inner surface 10*f* is in the form of a flat surface and a portion except for a concave portion 10*k* in the rear side inner surface 10*g* is in the form of a flat surface. The axial height of the inner cross section of the air channel 10*b* at a portion except for the concave portion 10*k* in the rear side inner surface 10*g* is kept constant.

If the impeller 12 is rotatably driven in a clockwise direction, the air introduced from the inlet 10*a* flows out radially outward via a space between the many wings 12*a* at the outer circumference of the impeller 12, the air flows in the air channel 10*b* toward the outlet 10*d*, and then, the air is discharged from the outlet 10*d*. According to the present example, the inlet is formed only at the front side of the casing 10, however, the inlet may be formed only at the rear side or may be formed at the both of the front side and the rear side.

In the air channel 10*b*, expect for a specific region 10*h* located at a left end in FIG. 1 and FIG. 3, the radial gap of the cross section in the air channel 10*b* (namely, the cross section from the clapper portion 10*c* to the outlet 10*d* being perpendicular to the axis of the air channel 10*b*) is gradually enlarged from the clapper portion 10*c* toward the outlet 10*d*.

In the specific region 10*h*, due to the restriction of the size of the centrifugal fan, a peripheral wall 10*w* of the casing 10 and the outer circumferential side inner surface 10*e* of the air channel 10*b* are formed in a straight line in FIG. 1 and FIG. 3. In addition, due to the restriction of the size of the centrifugal fan, the radial gap of the inner cross section of the air channel 10*b* is reduced toward the outlet 10*d*. On the other hand, at the rear side inner surface 10*g*, the concave portion 10*k* extended from the specific region 10*h* across the outlet 10*d* (namely, a chain line hatching portion in FIG. 3) is formed. Thereby, the inner cross section of the air channel 10*b* is enlarged in the axial direction with respect to the inner cross section of the air channel 10*b* near the clapper portion 10*c* rather than the specific region 10*h* to form the air channel enlarged portion. The cross section of this concave portion 10*k* is formed in a rectangle and its bottom surface is at right angles to the axis of the impeller 12. In the concave portion 10*k*, the axial gap is kept constant and the radial gap is gradually enlarged from the specific region 10*h* toward the outlet 10*d*. The axial height of the inner cross section of the air channel 10*b* in the concave portion 10*k* is kept constant.

Thereby, even at the specific region 10*h* where the radial gap of the inner cross sectional area of the air channel 10*b* is reduced toward the outlet 10*d*, the cross sectional area in the air channel 10*b* is gradually enlarged from the clapper portion 103*c* toward the outlet 10*d*. In addition, the cross sectional area in the air channel 10*b* is gradually enlarged from the clapper portion 10*c* toward the outlet 10*d* including the specific region 10*h* as a whole.

Therefore, it is possible to keep both of the diameter of the impeller 12 and the cross sectional area of the air channel 10*b* of the scroll casing 10 as large as possible while reducing the size of the centrifugal fan in the direction perpendicular to the axis of the impeller 12 at the specific region 10*h*. Thereby, it is possible to acquire characteristics of the high air volume and the high static pressure without lowering the efficiency.

Now, the second embodiment according to the present invention will be described below with reference to FIG. 4 and FIG. 5. In the meantime, since the basic structure of the motor of this embodiment is equal to that of the above-described first embodiment, a hundred's digit is given as the reference numeral of the corresponding member so as to clarify the relation and the further explanation is provided only about the different parts.

In an air channel 100*b*, when the radial gap of the cross section in the air channel 100*b* (namely, the cross section perpendicular to the axis of the air channel 100*b* from a clapper portion 100*c* to an outlet 100*d*) is gradually enlarged from the clapper portion 100*c* toward the outlet 100*d* except for a specific region 100*h*, the cross sectional area in the air channel 100*b* is gradually enlarged from the lapper portion 100*c* toward the outlet 100*d*.

Figure 4:
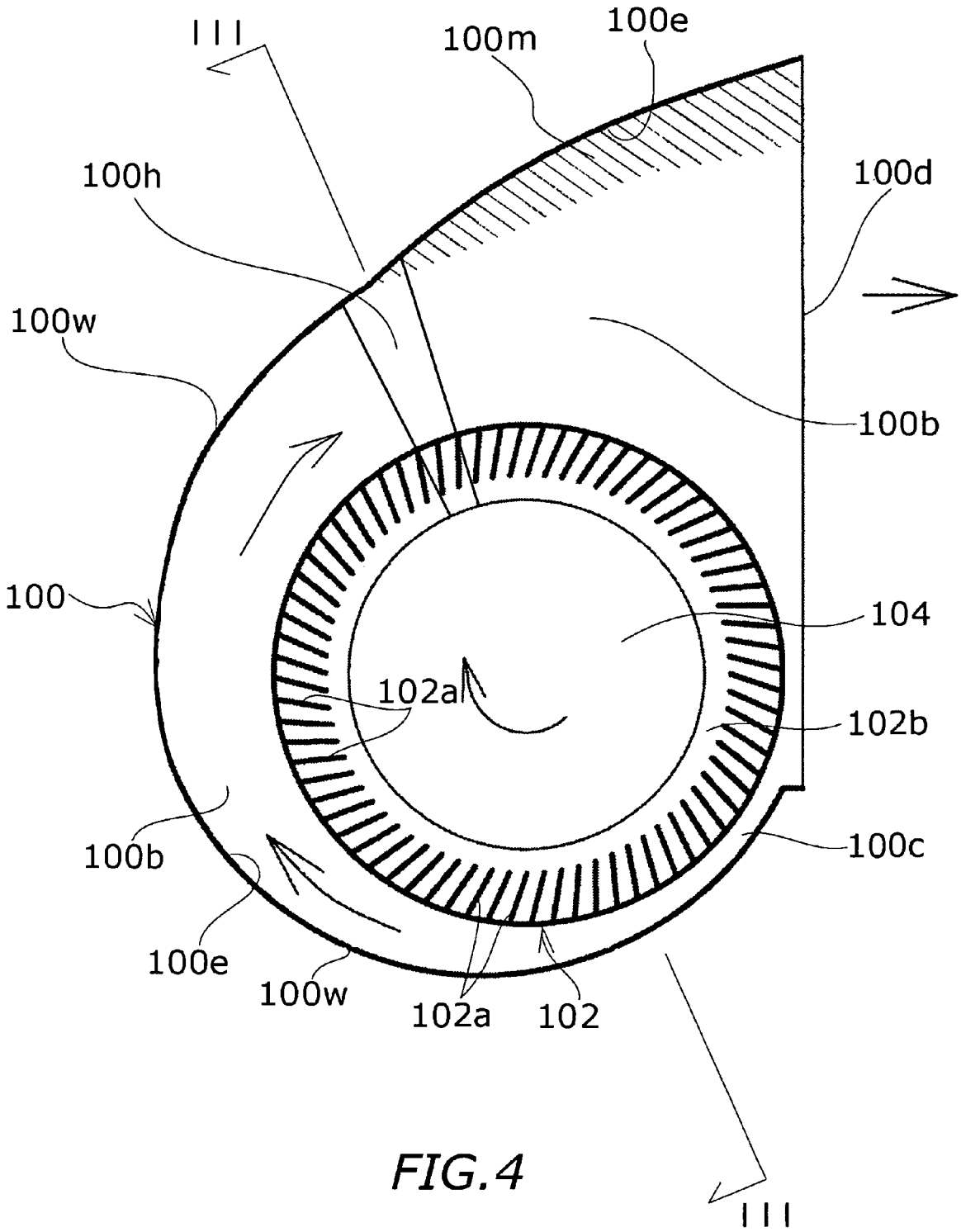
FIG. 4 is a cross sectional view of a centrifugal fan according to a second embodiment of the present invention.
Figure 5:
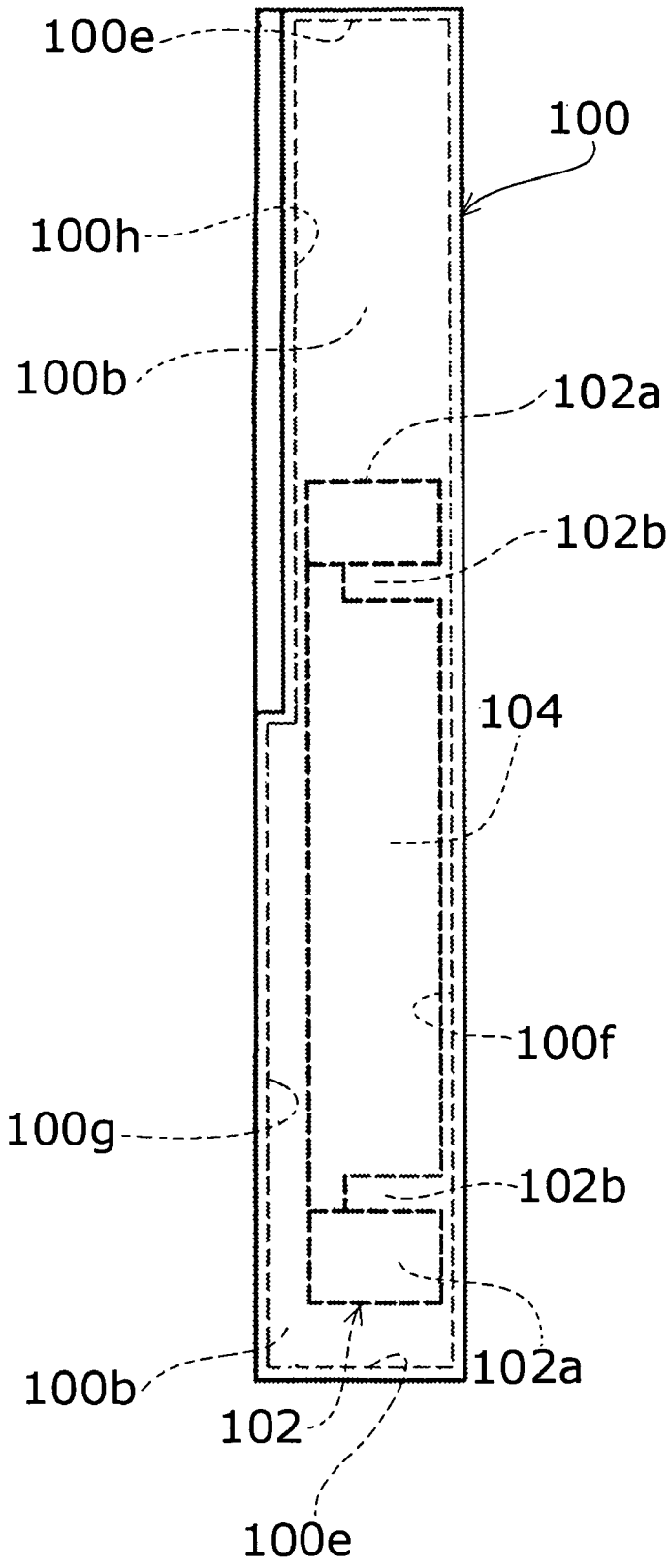
FIG. 5 is a cross sectional view of the centrifugal fan according to the second embodiment taken on a line III-III shown in FIG. 4.

At the specific region 100*h*, due to the restriction of the size of the centrifugal fan (for example, locking of a lead wire), a rear side inner surface 100*g* of a casing 100 is formed in a convex shape in FIG. 4 and FIG. 5. In addition, due to the restriction of the axial gap of the centrifugal fan, the axial gap of the inner cross section of the air channel 100*b* is reduced toward the outlet 100*d*. On the other hand, at the outer circumferential side inner surface 100*e*, an enlarged diameter portion 100*m*, in which radial gap is further enlarged from the specific region 100*h* to the outlet 100*d* (namely, a chain line hatching portion in FIG. 5), is formed. Thereby, the inner cross section of the air channel 100*b* is further enlarged in the radial direction with respect to the inner cross section of the air channel 100*b* near the clapper portion 100*c* rather than the specific region 100*h* to form the air channel enlarged portion. In this enlarged diameter portion 100*m*, the axial gap is kept constant and the radial gap is gradually enlarged from the specific region 100*h* toward the outlet 100*d*.

Thereby, even at the specific region 100*h* where the radial gap of the inner cross sectional area of the air channel 100*b* is reduced toward the outlet 100*d*, the cross sectional area in the air channel 100*b* is gradually enlarged from the clapper portion 100*c* toward the outlet 100*d*. In addition, the cross sectional area in the air channel 100*b* is gradually enlarged from the clapper portion 10*c* toward the outlet 100*d* including the specific region 100*h* as a whole.

Therefore, it is possible to keep both of the diameter of the impeller 102 and the cross sectional area of the air channel 100*b* of the scroll casing 100 as large as possible while reducing the size of the centrifugal fan in the direction perpendicular to the axis of the impeller 102 at the specific region 100*h*. Thereby, it is possible to acquire characteristics of the high air volume and the high static pressure without lowering the efficiency.

The embodiment of the centrifugal fan according to the present invention is described as above, however, the present invention is not limited to such an embodiment and various modifications are available if they do not deviate from the scope of the invention.

For example, the above-described specific regions 10*h* and 100*h* may be provided two or more. In addition, the specific regions 10*h* and 100*h* may be formed in a curved shape although the peripheral walls 10*w* and 100*w* of the casings 10, 100, the outer circumferential side inner surfaces 10*e* of the air channels 10*b* and 100*b* are formed in a straight line, and the rear side inner surface 100*g* is formed in a convex shape.

In addition, the concave portion 10*k* can be provided at the front side inner surface or at the both of the front side inner surface and the rear side inner surface. In addition, it is not required that the axial gap of the concave portion 10*k* is always kept constant and for example, it is also possible to gradually make the axial gap thick in a certain portion or entirely toward the outlet 10*d*.

It is not required that the radial gap of the concave portion 10*k* is always enlarged toward the outlet 10*d*, and for example, the certain portion or entire portion can be kept constant. Further, the concave portion 10*k* and the enlarged diameter portion 100*m* are formed from the specific regions 10*h*, 100*h* of the air channels 10*b*, 100*b* to the outlets 10*d*, 100*d*, however, by controlling the cross sectional areas of the air channels 10*b*, 100*b*, they may be also formed only in the specific regions 10*h* and 100*h*.

The present invention has the following advantages.

Namely, the present invention may comprise a centrifugal fan for use in an electric device comprising: a motor including a static part and a rotational part rotating around a rotational axis; an impeller having a tubular-shaped outline that is mounted on a radially outer circumferential part of the rotational part; and a casing housing the impeller and the motor, wherein the casing includes: an upper plate and a lower plate which are located in parallel and opposing each other in axial direction; a peripheral wall portion formed at a radially outer circumference of the casing, wherein a curvature radius of the peripheral wall portion with respect to the rotational axis is gradually enlarged; and a blowing opening formed by the opposite ends of the peripheral wall portion and ends of the upper plate and lower plate; wherein an air channel is formed within a space enclosed by the upper plate and the lower plate, a radial outer circumference of the impeller and an inner circumferential surface of the peripheral wall portion of the casing, a radial gap is defined as a distance from the radial outer circumference of the impeller to an inner circumferential surface of the peripheral wall portion and the radial gap is gradually enlarged along a rotational direction of the impeller except for one or more specific regions, an air channel enlarged part is located at a vicinity of the specific region, an axial gap between the upper plate and the lower plate at the air channel enlarged portion is enlarged along a rotational direction of the impeller, a cross sectional area of the air channel cut by a plain passing through the rotational axis is kept constant or is gradually enlarged along the rotational direction of the impeller.

In the above-described one or more specific regions, daringly, it is assumed that the radial gap of the cross section in the air channel is kept constant or is reduced toward the blowing opening. Thereby, the diameter of the impeller can be made larger as much as possible and when the plain passing through the rotational axis of the entire air channel is enlarged in the axial direction with respect to the plain at the side of the start point in the rotational direction of the impeller rather than the specific region, the cross sectional area cut at the plain passing through the rotational axis of the entire air channel is kept constant or is gradually enlarged along the rotational direction of the impeller. Therefore, as a whole, the cross section in the air channel including the specific region is gradually enlarged along the rotational direction of the impeller.

Thereby, it is possible to keep both of the diameter of the impeller and the cross sectional area of the air channel of the casing as large as possible while reducing the size of the centrifugal fan in a direction perpendicular to a rotational axis as much as possible. Thereby, it is possible to acquire characteristics of the high air volume and the high static pressure without lowering the efficiency.

The present invention may comprise the centrifugal fan according to claim 1, wherein the air channel enlarged part is formed at one or both of the upper plate and lower plate by providing a concave portion from the specific region to the blowing opening.

According to the present invention, the air channel is formed between the opposite surfaces opposing to each other in the axial direction (namely, the rotational axial direction) and composing the inner surface of the air channel, and the concave portion from the specific region to the blowing opening is formed on one or the both of these surfaces. Thereby, it is assumed that the cross sectional area in the air channel including the specific region is kept constant or is gradually enlarged along the rotational direction of the impeller.

The present invention may comprise the centrifugal fan according to claim 2, wherein in the concave portion, an axial gap is kept constant and a radial gap is kept constant or is gradually enlarged along a rotational direction of the impeller from the specific region.

According to the present invention, the axial gap of the concave portion is kept constant and the radial gap is gradually enlarged from the specific region toward the blowing opening. Thereby, it is assumed that the cross sectional area in the air channel including the specific region is kept constant or is gradually enlarged along the rotational direction of the impeller.

The present invention may comprise a centrifugal fan for use in an electric device comprising: a motor including a static part and a rotational part rotating around a rotational axis; an impeller having a tubular-shaped outline that is mounted on a radially outer circumferential part of the rotational part; and a casing housing the impeller and the motor, wherein the casing includes: an upper plate and a lower plate which are located in parallel and opposing each other in axial direction; a peripheral wall portion formed at a radially outer circumference of the casing, wherein a curvature radius of the peripheral wall portion with respect to the rotational axis is gradually enlarged; and a blowing opening formed by the opposite ends of the peripheral wall portion and ends of the upper and lower plates; wherein an air channel is formed within a space enclosed by the upper and the lower plates, a radial outer circumference of the impeller and an inner circumferential surface of the peripheral wall portion of the casing, a radial gap is defined as a distance from the radial outer circumference of the impeller to an inner circumferential surface of the peripheral wall portion and the radial gap is gradually enlarged along a rotational direction of the impeller except for one or more specific regions, an air channel enlarged part is located at a vicinity of the specific region, a radial gap between the radial outer circumference of the impeller and the inner circumferential side surface of the peripheral wall of the casing is enlarged along a rotational direction of the impeller, a cross sectional area of the air channel cut by a plain passing through the rotational axis is kept constant or is gradually enlarged along the rotational direction of the impeller.

According to the present invention, in the air channel is kept constant in an axial gap between the upper plate and lower plate except for one or more specific regions, the radial gap of the cross section in the air channel is gradually enlarged along the rotational direction of the impeller. Thereby, it is assumed that the cross sectional area in the air channel is gradually enlarged along the rotational direction of the impeller.

In the above-described one or more specific regions, daringly, the axial gap of the inner cross section in the air channel is reduced toward the blowing opening. Thereby, it is possible to make the axial gap of the inner cross section in the air channel larger as much as possible and the inner cross section in the air channel is enlarged in the radial direction with respect to the plain at the start side of the rotational direction of the impeller rather than the specific region, so that the cross sectional area is gradually enlarged along the rotational direction of the impeller. Therefore, it is assumed that the cross sectional area in the air channel including the specific region is gradually enlarged along the rotational direction of the impeller as the whole.

Thereby, it is possible to keep both of the diameter of the impeller and the cross sectional area of the air channel of the scroll casing as large as possible while reducing the size of the centrifugal fan in the axial direction of the impeller as much as possible. Thereby, it is possible to acquire characteristics of the high air volume and the high static pressure without lowering the efficiency.

This application is based on Japanese Patent Application Ser. No. 2004-336702 filed in Japan Patent Office on Nov. 19, 2004, the contents of which are hereby incorporated by reference.

What is claimed is:

1. A centrifugal fan for use in an electric device comprising:

a motor including a static part and a rotational part rotating around a rotational axis;

an impeller having a tubular-shaped outline that is mounted on a radially outer circumferential part of the rotational part; and a casing housing the impeller and the motor, wherein the casing includes:

an upper plate and a lower plate which are located in parallel and opposing each other in axial direction;

a peripheral wall portion formed at a radially outer circumference of the casing, wherein a curvature radius of the peripheral wall portion with respect to the rotational axis is gradually enlarged; and a blowing opening formed by the opposite ends of the peripheral wall portion and ends of the upper plate and lower plate;

wherein an air channel is formed within a space enclosed by the upper plate and the lower plate, a radial outer circumference of the impeller and an inner circumferential surface of the peripheral wall portion of the casing, wherein a radial gap is defined as a distance from the radial outer circumference of the impeller to an inner circumferential surface of the peripheral wall portion and the radial gap is gradually enlarged along a rotational direction of the impeller except for at least one specific region provided at the peripheral wall portion of the casing, while the radial gap is kept constant or gradually reduced in the specific region, wherein an air channel enlarged part is located at a vicinity of the specific region, wherein an axial gap between the upper plate and the lower plate at the air channel enlarged portion is enlarged along a rotational direction of the impeller, and wherein a cross sectional area of the air channel cut by a plane passing through the rotational axis is kept constant or is gradually enlarged along the rotational direction of the impeller.

2. The centrifugal fan according to claim 1, wherein the air channel enlarged part is formed at one or both of the upper plate and lower plate by providing a concave portion from the specific region to the blowing opening.

3. The centrifugal fan according to claim 2, wherein in the concave portion, an axial gap is kept constant and a radial gap is kept constant or is gradually enlarged along a rotational direction of the impeller from the specific region.

4. The centrifugal fan according to claim 1, wherein the inner surfaces of the upper plate and lower plate are formed perpendicular to the axis of the impeller.

5. The centrifugal fan according to claim 1, wherein the plane passing through the rotational axis of the entire air channel is formed by a side in parallel with the rotational axis and a side perpendicular to the rotational axis.

6. A centrifugal fan for use in an electric device comprising:

a motor including a static part and a rotational part rotating around a rotational axis;

an impeller having a tubular-shaped outline that is mounted on a radially outer circumferential part of the rotational part; and a casing housing the impeller and the motor, wherein the casing includes:

an upper plate and a lower plate which are located in parallel and opposing each other in axial direction;

a peripheral wall portion formed at a radially outer circumference of the casing, wherein a curvature radius of the peripheral wall portion with respect to the rotational axis is gradually enlarged; and a blowing opening formed by the opposite ends of the peripheral wall portion and ends of the upper and lower plates;

wherein an air channel is formed within a space enclosed by the upper and the lower plates, a radial outer circumference of the impeller and an inner circumferential surface of the peripheral wall portion of the casing, wherein a radial gap is defined as a distance from the radial outer circumference of the impeller to an inner circumferential surface of the peripheral wall portion and the radial gap is gradually enlarged along a rotational direction of the impeller except for at least one specific region provided at therein while the radial gap is kept constant or gradually reduced in the specific region, wherein an air channel enlarged part is located at a vicinity of the specific region, wherein a radial gap between the radial outer circumference of the impeller and the inner circumferential side surface of the peripheral wall of the casing is enlarged along a rotational direction of the impeller, and wherein a cross sectional area of the air channel cut by a plane passing through the rotational axis is kept constant or is gradually enlarged along the rotational direction of the impeller.

* * * * *